US008579392B2

(12) United States Patent
Huber

(10) Patent No.: US 8,579,392 B2
(45) Date of Patent: Nov. 12, 2013

(54) EJECTION DEVICE FOR A MOVABLE FURNITURE PART

(75) Inventor: Edgar Huber, Hard (AT)

(73) Assignee: Julius Blum GmbH, Höchst (AT)

( * ) Notice: Subject to any disclaimer, the term of this patent is extended or adjusted under 35 U.S.C. 154(b) by 896 days.

(21) Appl. No.: 11/976,755

(22) Filed: Oct. 26, 2007

(65) Prior Publication Data

US 2008/0100189 A1 May 1, 2008

Related U.S. Application Data

(63) Continuation of application No. PCT/AT2006/000061, filed on Feb. 17, 2006.

(30) Foreign Application Priority Data

Apr. 28, 2005 (AT) ..... 722/2005

(51) Int. Cl.
*A47B 97/00* (2006.01)

(52) U.S. Cl.
USPC ..... 312/319.1

(58) Field of Classification Search
USPC ..... 312/257.1, 319.1, 319.2, 319.5, 319.6, 312/319.7, 319.8, 330.1, 333, 334.2; 318/466
See application file for complete search history.

(56) References Cited

U.S. PATENT DOCUMENTS

| | | | | | |
|---|---|---|---|---|---|
| 1,334,712 | A | | 3/1920 | Olson | |
| 2,223,071 | A | * | 11/1940 | Koch | 312/334.25 |
| 2,730,053 | A | * | 1/1956 | Ellithorpe | 109/19 |
| 5,338,922 | A | * | 8/1994 | Kim et al. | 219/763 |
| 5,860,717 | A | * | 1/1999 | Mizrahi | 312/322 |

FOREIGN PATENT DOCUMENTS

| | | |
|---|---|---|
| CN | 1 428 115 | 7/2003 |
| DE | 1 778 452 | 10/1971 |
| DE | 24 19 116 | 11/1975 |
| EP | 0 760 309 | 3/1997 |
| EP | 1 323 363 | 7/2003 |
| GB | 2 374 521 | 10/2002 |
| JP | 9-158604 | 6/1997 |
| JP | 2004-41616 | 2/2004 |
| WO | 2004/100718 | 11/2004 |

OTHER PUBLICATIONS

International Search Report issued May 3, 2006 in the International (PCT) Application of which the present application is the U.S. National Stage.

* cited by examiner

*Primary Examiner* — James O Hansen
(74) *Attorney, Agent, or Firm* — Wenderoth, Lind & Ponack, L.L.P.

(57) ABSTRACT

An ejection device is provided for a moveable part of a piece of furniture. The ejection device includes a lever for transmitting force to the moveable part of the piece of furniture. The lever has a lever member which is mounted so as to be rotatable by a limited degree about an axis of rotation while having a free lever end. The lever member is provided with a curved section that is spaced apart from the axis of rotation and the free lever end.

22 Claims, 22 Drawing Sheets

8

Fig. 1c PRIOR ART
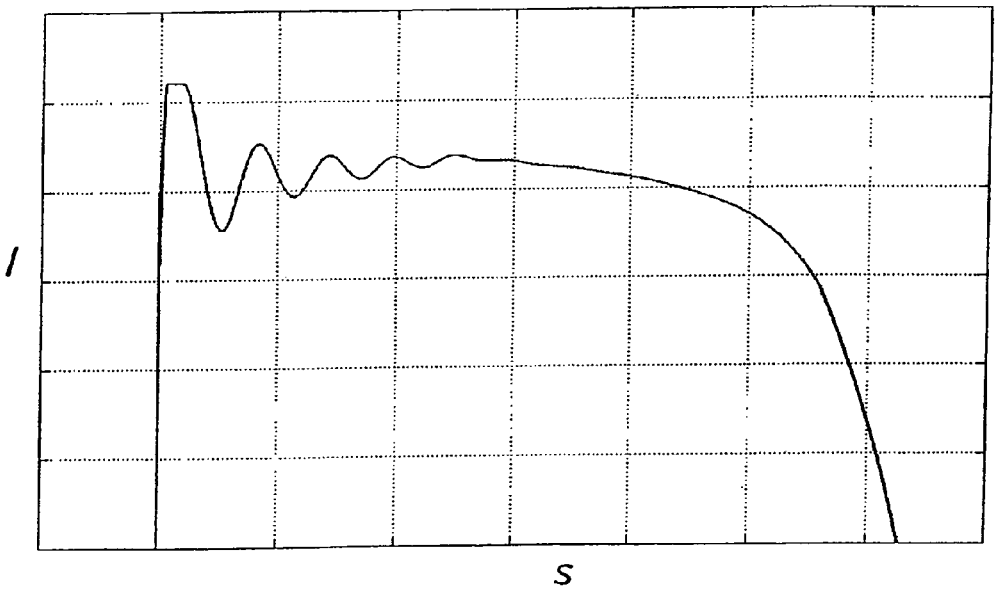

Fig. 2b PRIOR ART
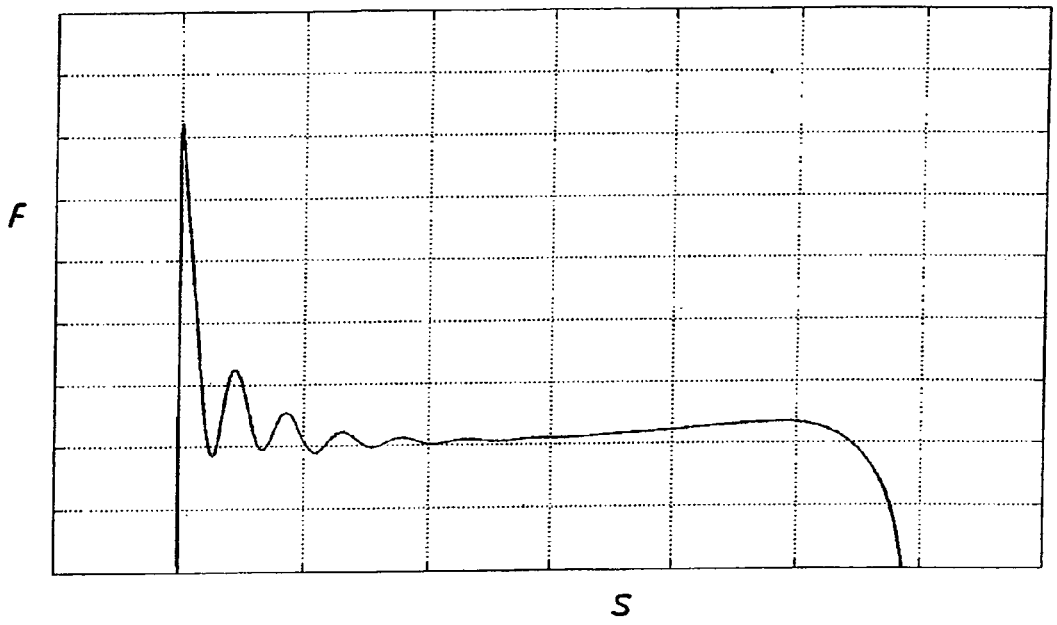

Fig. 2c PRIOR ART
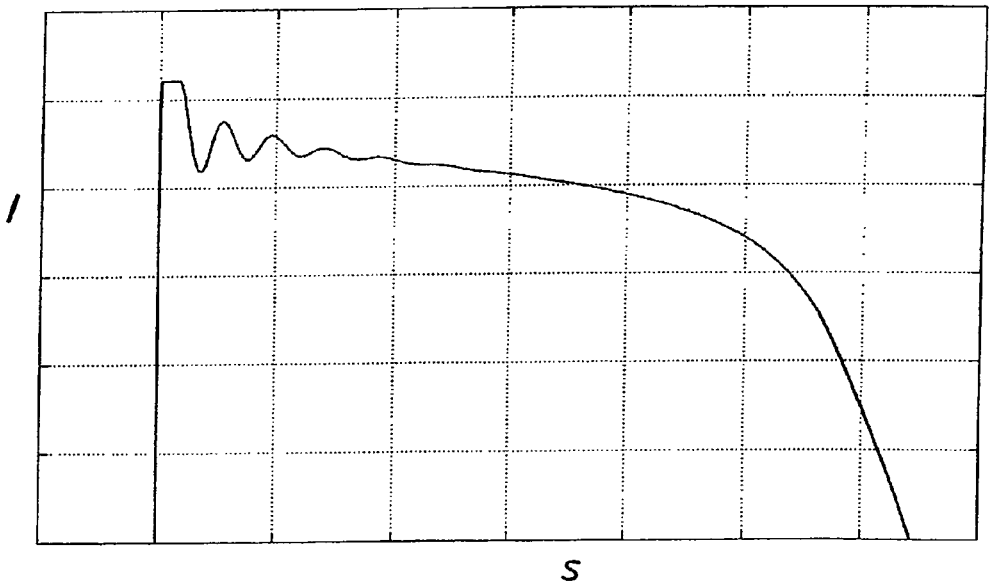

8

Fig. 9a PRIOR ART
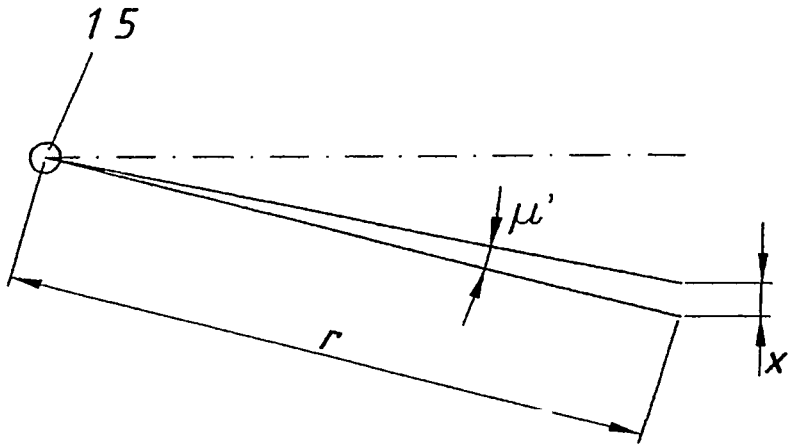
Fig. 9b
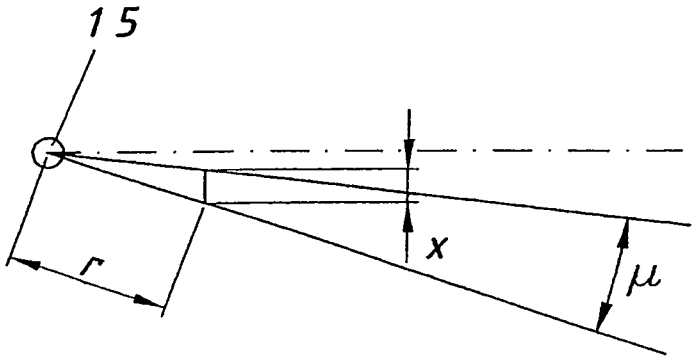

EJECTION DEVICE FOR A MOVABLE FURNITURE PART

This application is a continuation of International Application No. PCT/AT2006/000061, filed Feb. 17, 2006.

BACKGROUND OF THE INVENTION

This invention concerns an ejection device for a movable furniture part with a lever for transferring force to the movable furniture part. The lever has a lever body which is pivot-mounted within limits around a fulcrum point, and the lever body has a free end.

Ejection devices of this type have been used for a long time. A torque M is applied to the lever body by an actuator, usually an electrical device. If the ejection device is arranged in a furniture body, the force F exerted by the lever body on the movable furniture part with a moment arm r is given by the formula F=M/r.

Given a torque M exerted by the actuator, it follows that the force F applied to the movable furniture part is smaller, the longer the moment arm r. Of course, the magnitude of the moment arm r corresponds to the distance between the fulcrum point and the position where the lever body contacts the movable furniture part. Since, according to the state of the art, the lever body rests on the movable furniture part with its free end, the moment arm r usually corresponds to the length of the lever body.

Since the distance over which the lever body can apply a force F to the movable furniture part before the movable furniture part clears the lever body is affected by the length of the lever body, the lever body cannot be configured too short.

FIG. 1*a* shows in diagrammatic form an ejection device 1 with a housing 5 to which a lever 2 is pivot-mounted such that it will rotate within a limited angle. The ejection device 1 is assembled to a carrier element 6 and comprises an electric motor (electrical actuator) 15 to actuate the lever 2. The carrier element 6 is arranged on a furniture body 16 (see FIG. 10). Lever 2 comprises a lever body 3 having a base (fulcrum) end and a free end 4. An idler roller 7 is arranged on the free lever end 4. FIG. 1*a* deals with a drawer 17 (see FIG. 10) as the movable furniture part 8 which is resting in the closed end position in the furniture body 16. The idler roller 7 rests on a rear wall of the drawer.

FIG. 1*b* shows the force F exerted by the lever on the rear wall of the drawer and plotted versus path s. In this, the path s refers to the distance covered by the rear wall of the drawer from the closed end position to the point where it loses contact with lever 2. FIG. 1*c* shows a graph of the current drawn by the electric motor over the path s. The problem in this state of the art is that the force acting on the movable furniture part at the start of the ejection path s is relatively small.

As shown in FIG. 2*a*, an attempt was made, therefore, to improve the arrangement by adding a further roller 7 about half way along the lever. (This design is not a part of the invention).

It follows from FIG. 2*b* that this measure actually results in a considerable rise in the force F exerted initially on the movable furniture part 8. However, a significant disadvantage in this design version can be deduced from FIG. 2*b* and FIG. 2*c*, namely, that as soon as the lever 2 has swung out to the point where the second roller 7, arranged at the free lever end 4, comes to rest on the movable furniture part 8, a leap occurs in the force F and current I. This leap is based on the fact that when the second idler roller 7 comes into contact with movable furniture part 8, the effective moment arm r suddenly lengthens, causing a sudden reduction in the force F. As FIG. 2*c* shows, this leads to a sudden increase in the current I supplied to the electric motor, since the latter needs an increase in torque M to supply the same force F now that the moment arm r has lengthened. Since the only way that this can be done is at a lower motor speed, the motor is forced to slow down.

This exposes the disadvantage in the state of the art in that, due to the long moment arm r, only a small force F can be applied to the movable furniture part. In the initial acceleration phase in particular, in which the movable furniture part has to be accelerated from a rest position by overcoming its mass inertia, this causes a high load on the actuator and a slow ejection process due to the slow acceleration.

SUMMARY OF THE INVENTION

The task of this invention is to devise an ejection device which avoids these problems. The task is resolved by the ejection device described below.

In general, by providing a curved section at some distance from a base end which provides the fulcrum and the free end, this has the effect that, where an ejection device according to the invention is fitted into a furniture body, the lever body in the closed end position of the movable furniture part first contacts the curved section on the movable furniture part. This means that effectively, at the very start of the ejection process, a shorter moment arm is provided than is the case in the state of the art with a lever body of the same dimensions.

The result of this is that, at the start of the ejection process, a given torque M in the actuator is converted into a greater force F applied to the movable furniture part. On the one hand, this restricts the load on the actuator (for example in the case of an electrical actuator, this takes the form of a lower thermal load), and, on the other hand, it shortens the ejection time by providing quicker acceleration. A further benefit is that, due to the lower load on the actuator, there is less noise than in the state of the art. It has also been found by chance that, due to the flexibility in the components involved (lever body, components in the movable furniture part and in the furniture body), the mechanical vibrations unavoidably occurring in an ejection device according to the invention are significantly reduced compared with the state of the art.

Provision can be made in a beneficial version of the invention that the lever body is oblong in shape and at least one further curved section is located adjacent to the curved section. This additional section can extend right to the free end and/or to the fulcrum. Depending on the dimensioning of the curved section, this makes the lever easier to rotate.

It can be arranged, for example, that the curved section can be arc-shaped. If additional curved sections are provided, these curved sections can be part of the same arc.

A particularly beneficial arrangement is to form the curved section such that, with the ejection device fitted, the point at which the lever body touches the movable furniture part can change, when pushing the movable furniture part towards the free end of the lever. The effect of this is to uniformly change the moment arm r and thereby avoid sudden changes in the applied force F.

A simple means of releasing the ejection device is by using a touch-latch system. In this case, it can be arranged that a sensor, preferably a rotary potentiometer, is fitted to capture the angular position of the lever. For example, provision can be made that the signals from the sensor are transmitted to an actuation control unit, and the actuator for the ejection device is activated by the actuation control unit.

With the ejection device fitted to the furniture body in an item of furniture, the ejection device can of course be arranged so that the lever body is resting or can rest with its curved section on the movable furniture part when the movable furniture part is in its closed end position.

Where a touch-latch system is used, in its fitted position the ejection device is released by pushing the movable furniture part in its closed end position inwards into the furniture body.

It turns out, surprisingly, that, in a particularly beneficial design of the invention, the ejection process is improved considerably by providing a raised area on the movable furniture part which interacts with the curved section on the lever body. This arrangement helps by ensuring that the point on the movable furniture part contacted by the lever body is generally established in a given position, namely the raised area, throughout the entire ejection process. The effect is to provide a uniform application of force by the ejection device on the movable furniture part.

It can be arranged, for example, that the raised area comprises an idler roller arranged on the movable furniture part.

To arrange that the torque M exerted by the actuator during the initial acceleration phase of the movable furniture part is converted into as large a force F as possible, a further beneficial design version of the invention provides that the ejection device is arranged in the furniture body such that the point on the movable furniture part contacted by the lever body, with the former in the closed end position, is located near the fulcrum point.

For example, in this design version the contact point is located more than half of the length of the lever body away from the free lever end.

Examples of movable furniture parts within the meaning of this disclosure include drawers, lids and furniture doors.

If the movable furniture part is a drawer, the rear wall of the drawer is particularly suitable as a place where the lever can apply a force. A particularly beneficial arrangement in this case is to have the lever rest on the rear wall of the drawer with the latter in its closed end position.

Where the movable furniture part is a lid or a door, it can be arranged that the lever rests on the lid leaf or door leaf respectively when either is in its closed end position.

BRIEF DESCRIPTION OF THE DRAWINGS

Further advantages and details of the invention are illustrated using the following figures and the descriptions referring to them, in which.

Note that the same scale was used in all of the illustrations.

DETAILED DESCRIPTION OF THE INVENTION

Figure 2A:
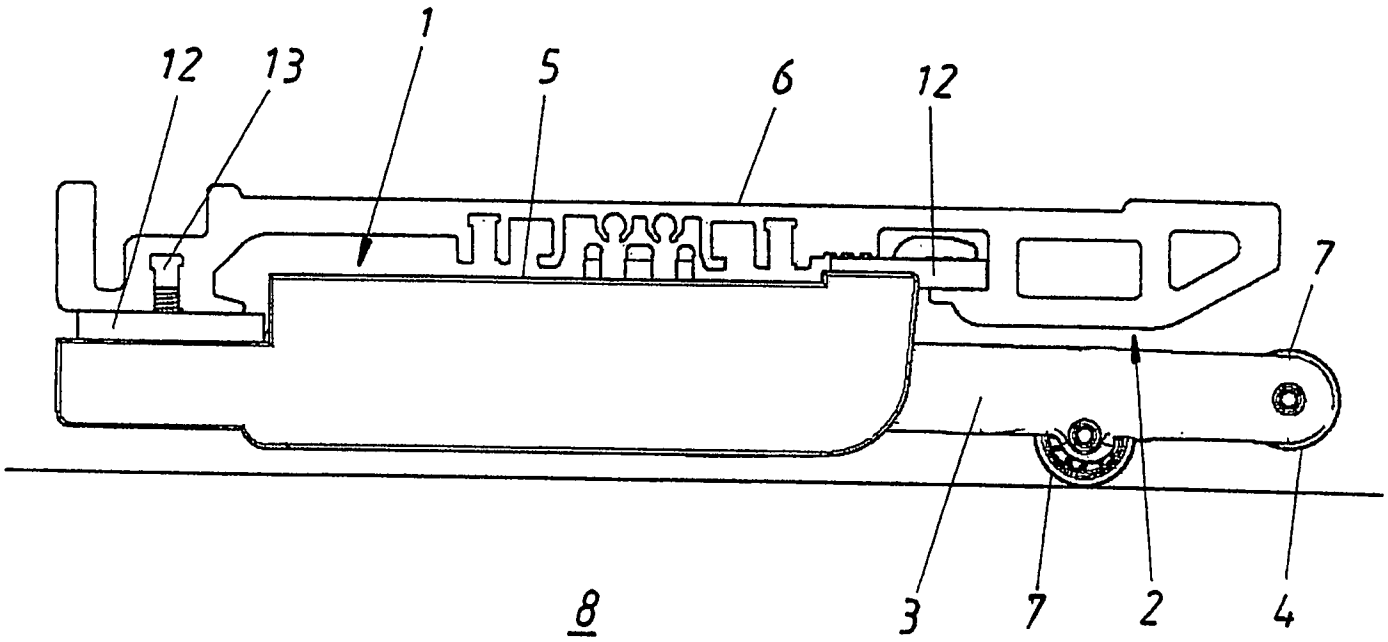
Fig 2a PRIOR ART
Figure 3A:
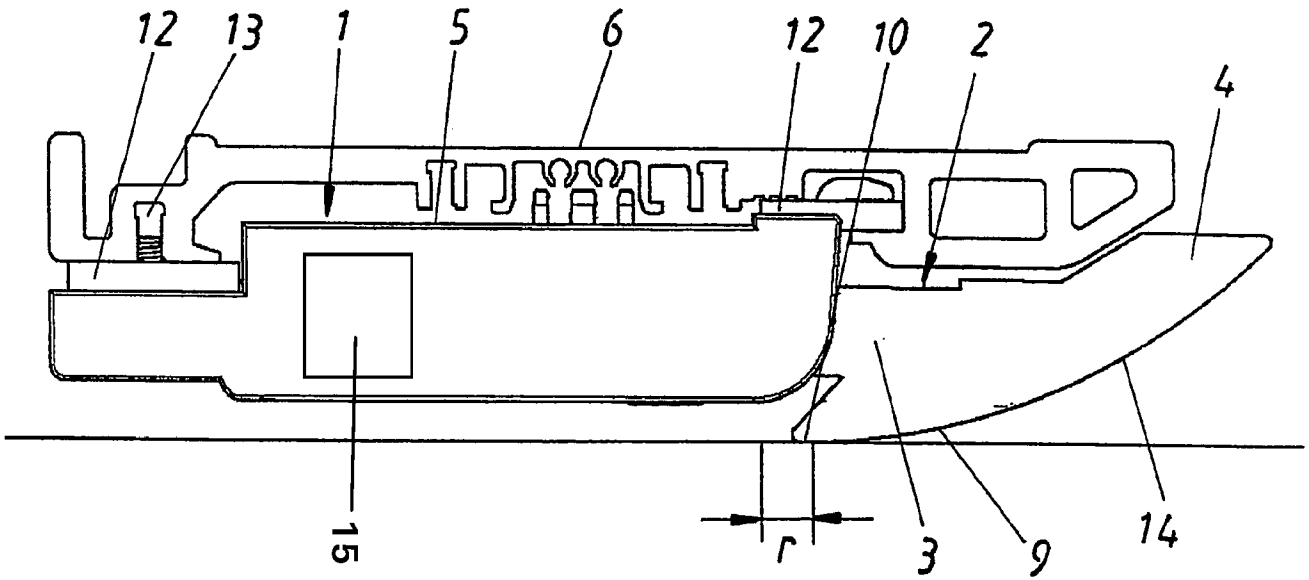
Figure 3B:
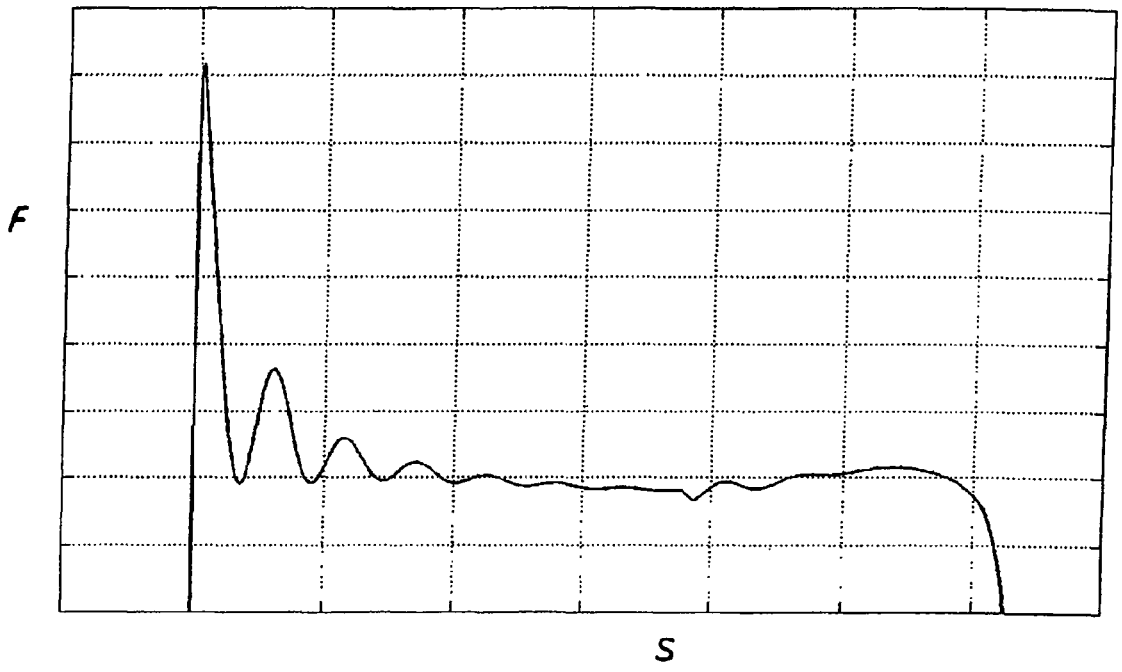
Figure 3C:
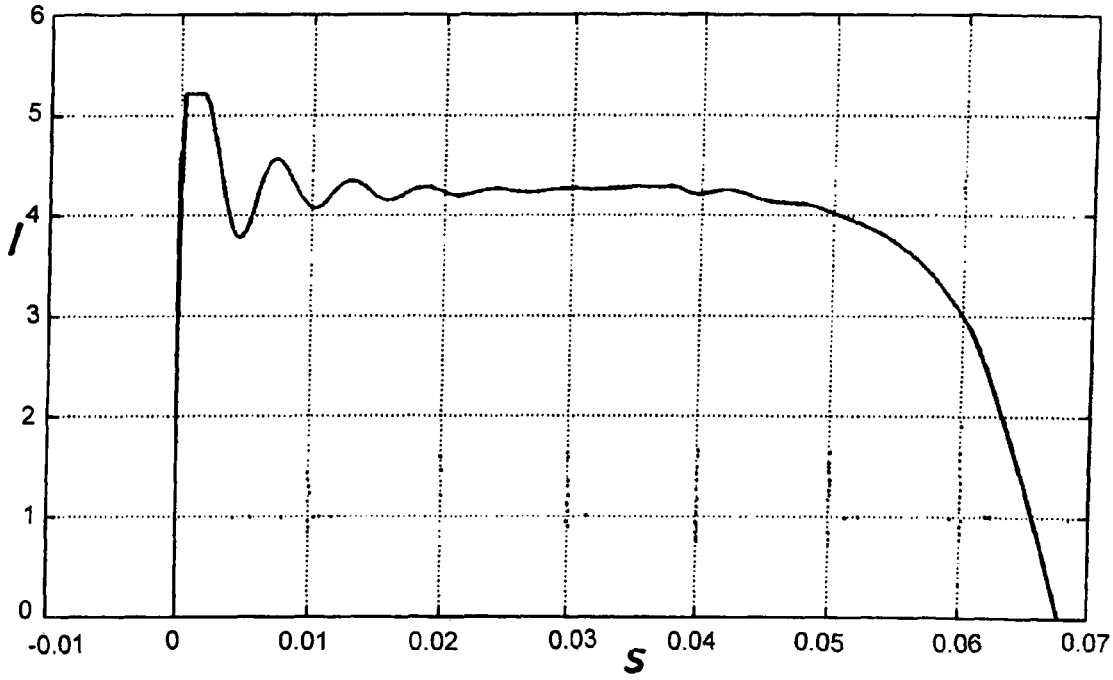

An example of a first design version of an ejection device 1 according to the invention is now shown in FIG. 3*a*. According to the invention, the lever body has a first curved section 9 at some distance from both the fulcrum as well as from the free lever end 4. In this particular design version, a further (second) curved section 14 is arranged next to the curved section 9, and extends right to the free lever end 4. As can be seen immediately from FIG. 3*b*, the initial force F exerted by lever 2 on the movable furniture part 8 is considerably larger than is the case in the design versions in FIGS. 1*a* and 2*a*. This is due to the fact that the place (point of contact) 10 where the lever body 3 contacts the movable furniture part 8 in its closed end position is located near the fulcrum point. As can be seen from FIG. 3*b*, a sudden change in force F (and in current I: cf. FIG. 3*c*) in the design according to the invention is avoided. In addition, the curved section 9 means that the place (point) 10 where the lever body 3 contacts the movable furniture part 8 can continuously move towards the free lever end 4 as the movable furniture part 8 is being ejected. This results in a continuous increase in the moment arm r.

Figure 4A:
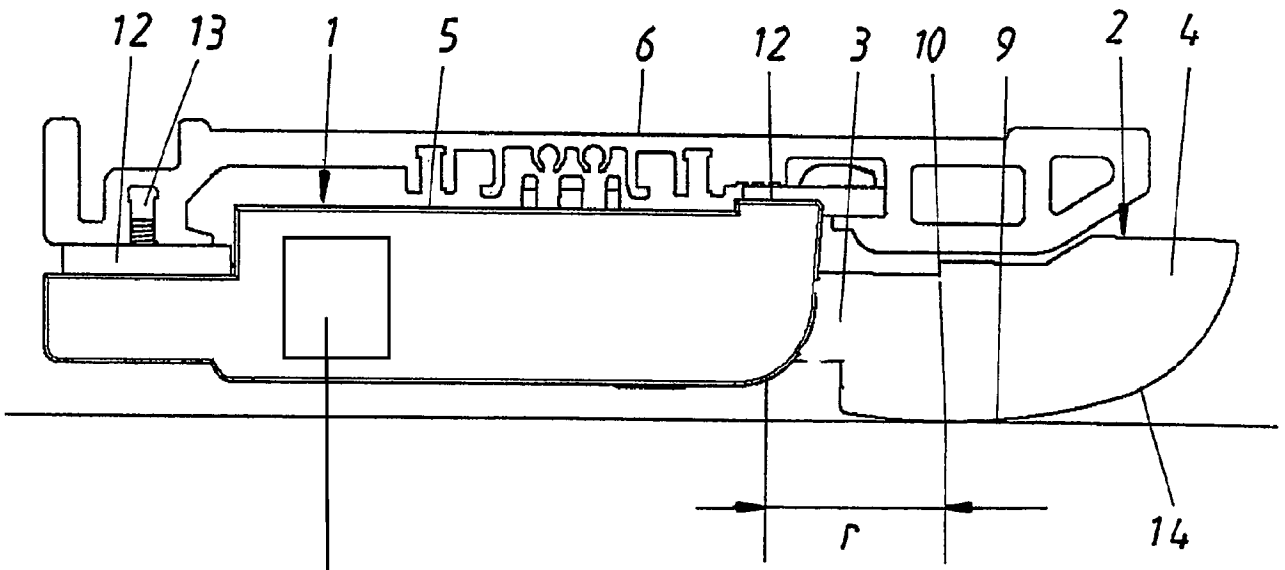
Figure 4B:
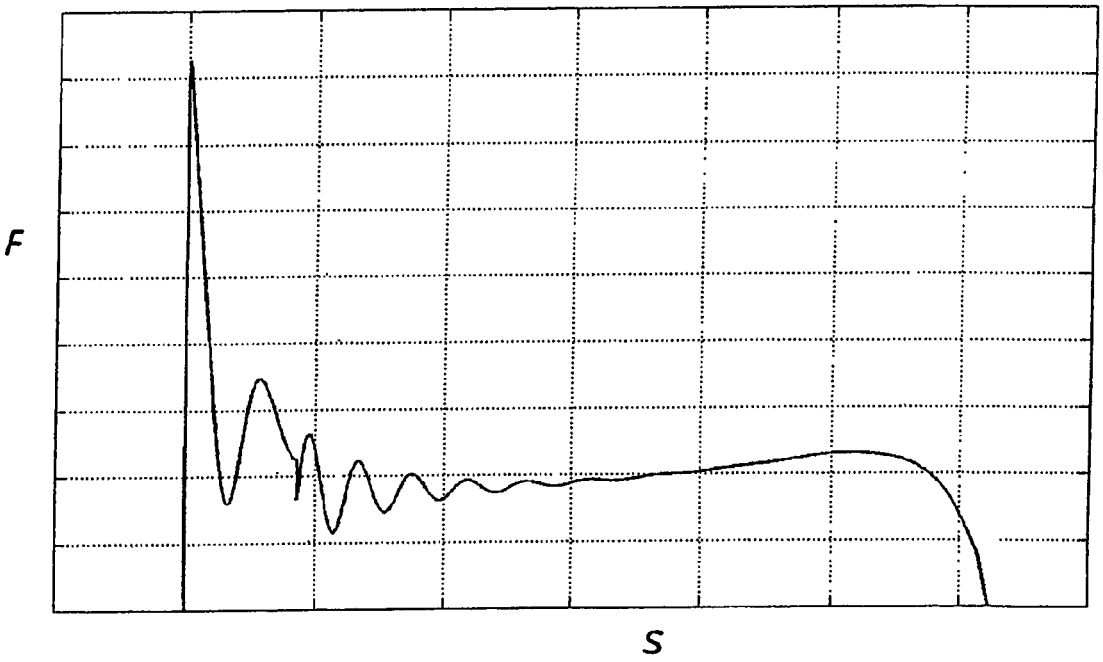
Figure 4C:
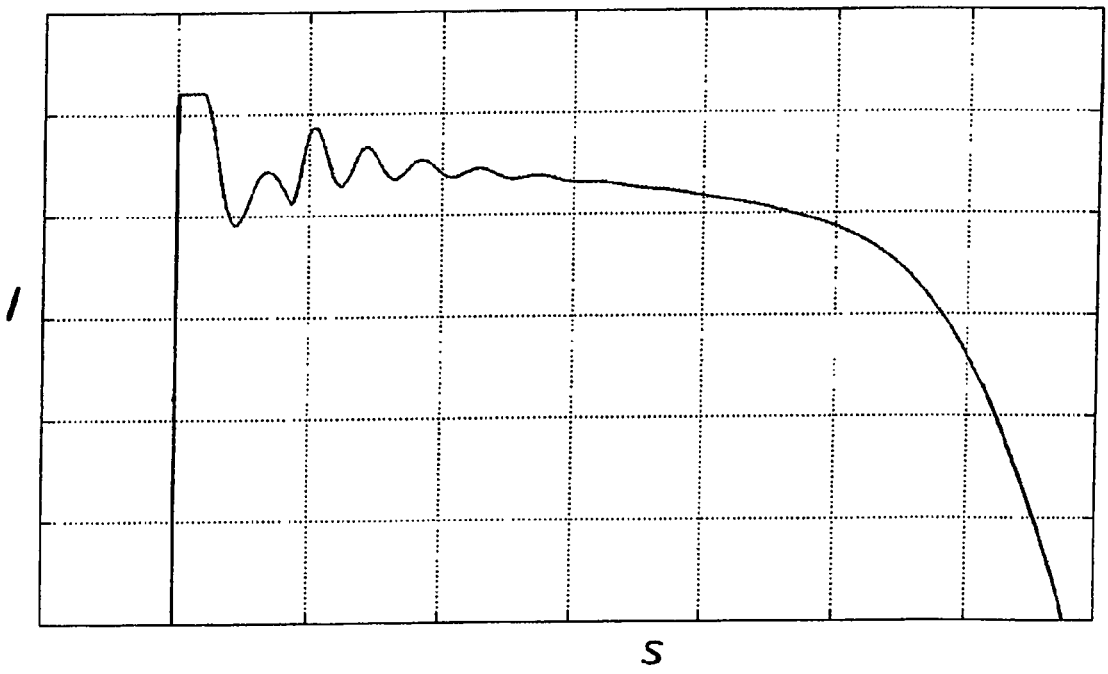

This effect occurs also in the design version according to the invention shown in FIG. 4*a*. In this design version, the contact point 10 is initially further away from the fulcrum than in the design version shown in FIG. 3*a*. Therefore, the initial force F is somewhat less than for the design of FIG. 3*a* (cf. FIGS. 3*b* and 4*b*). As illustrated in FIG. 4*a*, the first curved section 9 (i.e., the curved section closest to the fulcrum) has a larger radius of curvature than the second curved section 14.

Figure 5A:
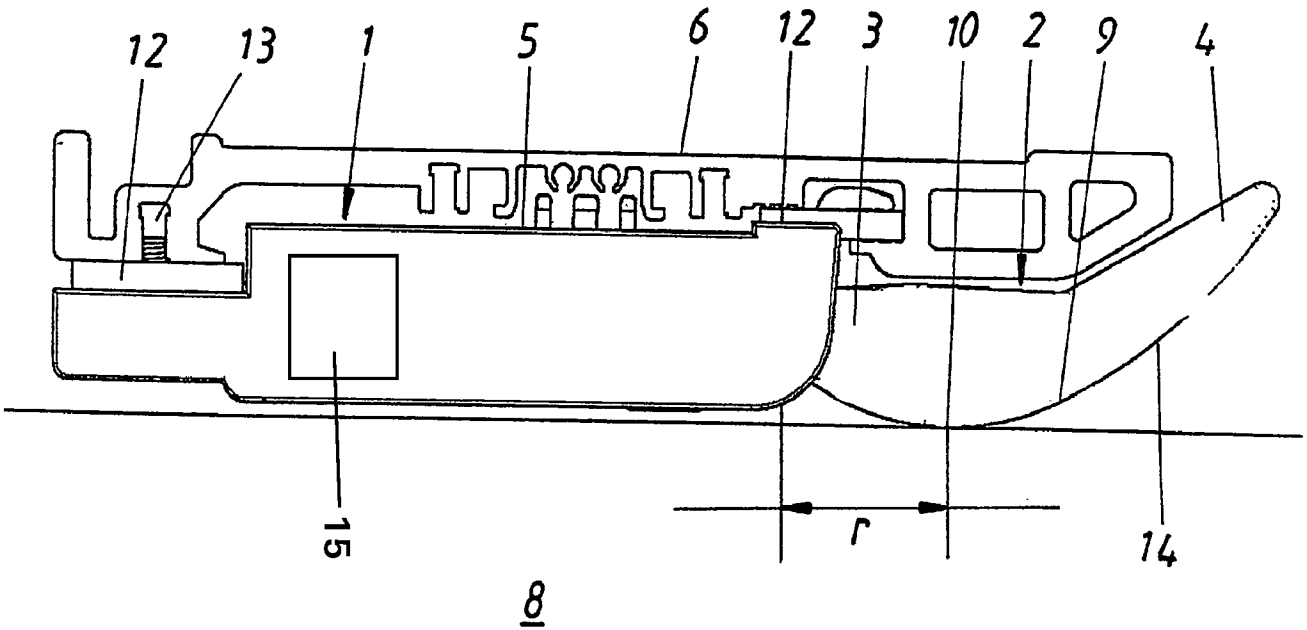
Figure 5B:
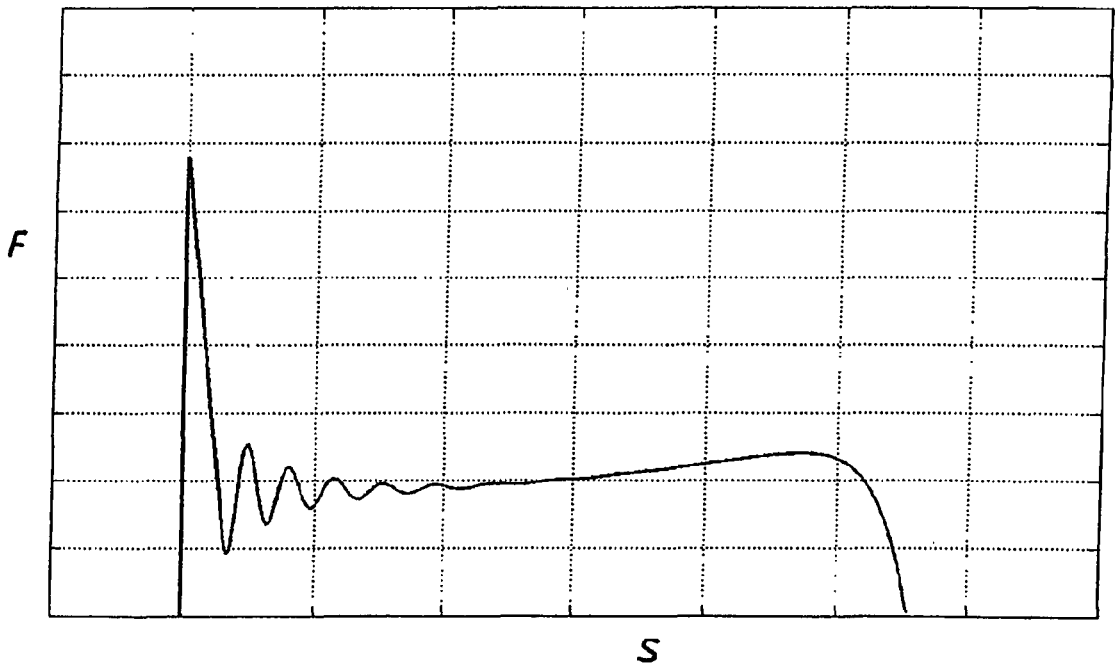
Figure 5C:
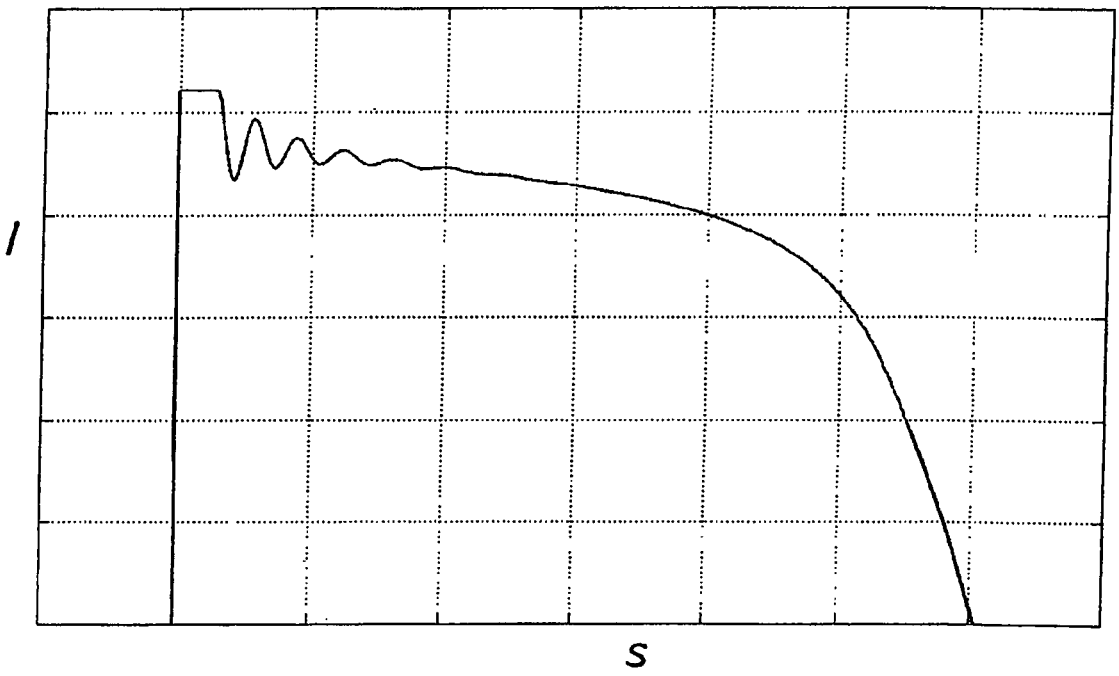

An example of a further design version according to the invention is shown in FIG. 5*a*. Here also the beneficial force-path and current-path resulting from the shape, according to the invention, of the lever body 3 can be seen in FIGS. 5*b* and 5*c*. In particular, the lever body 3 shown in FIG. 5*a* has a first curved section 9 (closest to the fulcrum) with a radius of curvature smaller than that of the second curved section 14, leading to the beneficial torque curve for the motor, as indicated by the graphs of FIGS. 5*b* and 5*c*.

Figure 6A:
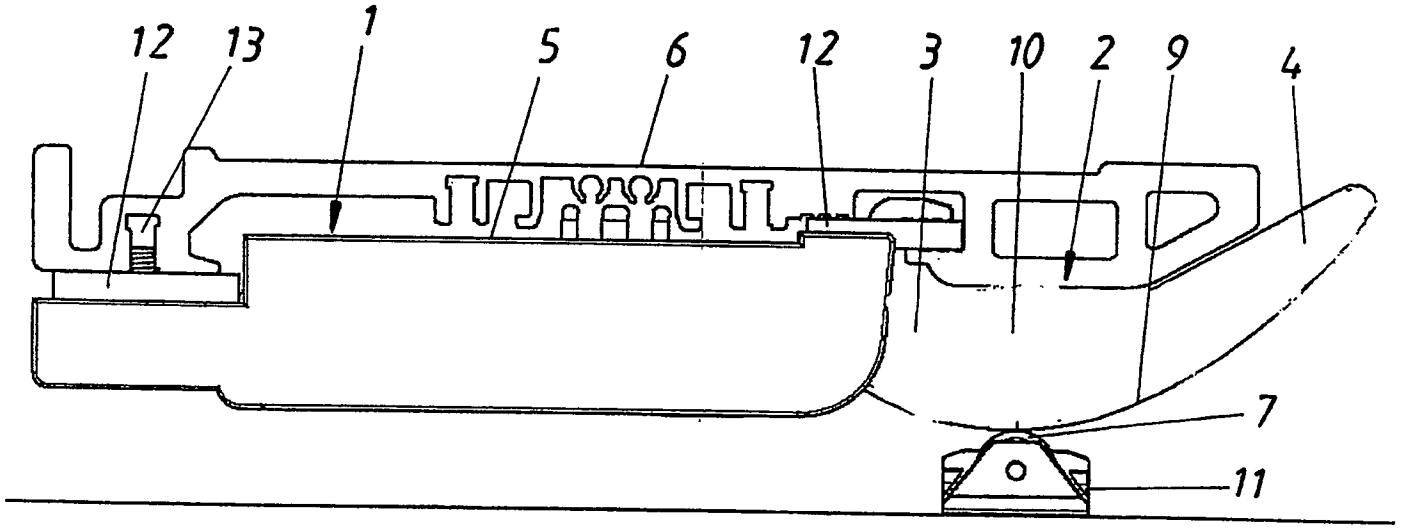
Figure 6B:
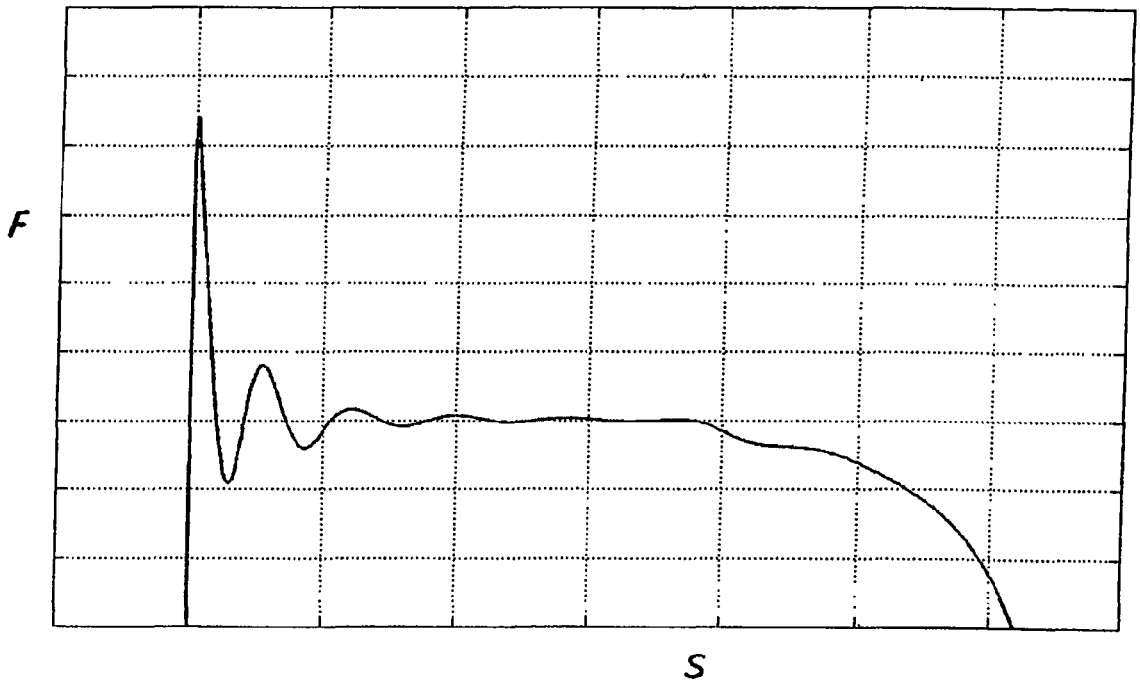
Figure 6C:
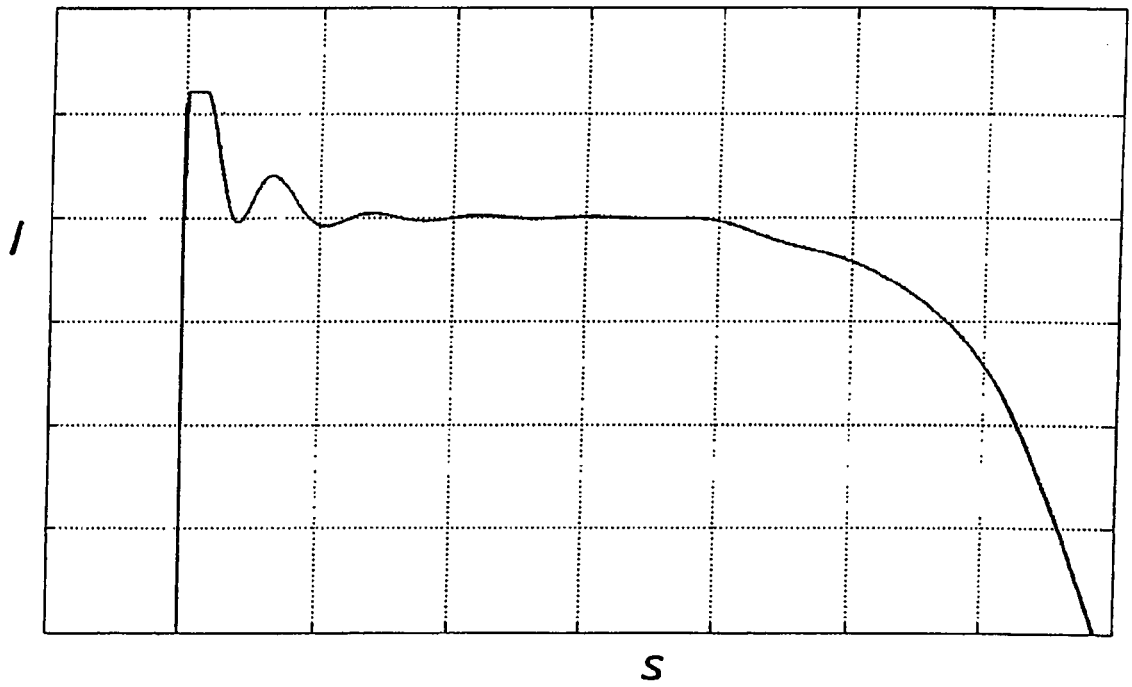

FIG. 6*a* shows a further design version according to the invention in which the ejection device 1 from FIG. 5*a* is used. Additionally, a raised area 11 is arranged on the movable furniture part 8 with which the curved section 9 of the lever body 3 interacts. In this design version, a raised area 11 is applied to the rear wall of the drawer. The raised area 11 comprises an idler roller 7. The result of this measure is that place 10 where the lever body 3 applies force to the movable furniture part 8 does not change essentially on the movable furniture part 8 during the entire ejection process. As can be seen in FIGS. 6*b* and 6*c*, after an initial peak in force F and current I, this results in a particularly beneficial uniform curve for force F and current I.

Figure 7:
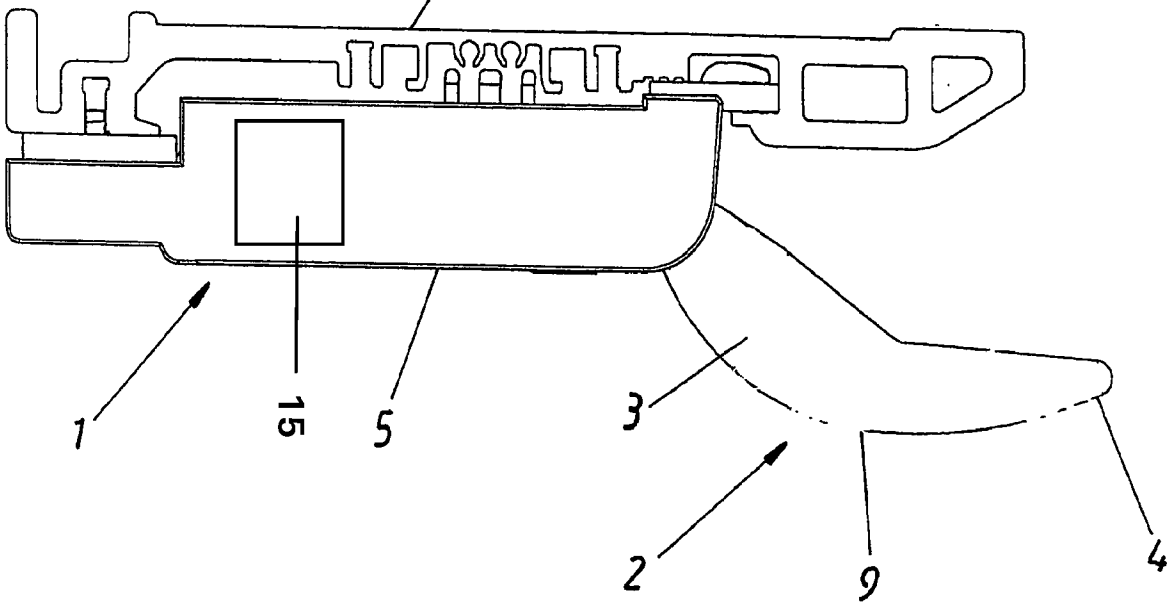
FIG. 7 is a diagrammatic illustration of the design example shown in FIG. 6*a* with the lever swung out.

FIG. 7 is provided as an example for other design versions of the ejection device 1 from FIG. 5*a* according to the invention to show the condition where the lever 2 is in its fully extended position.

Figure 8:
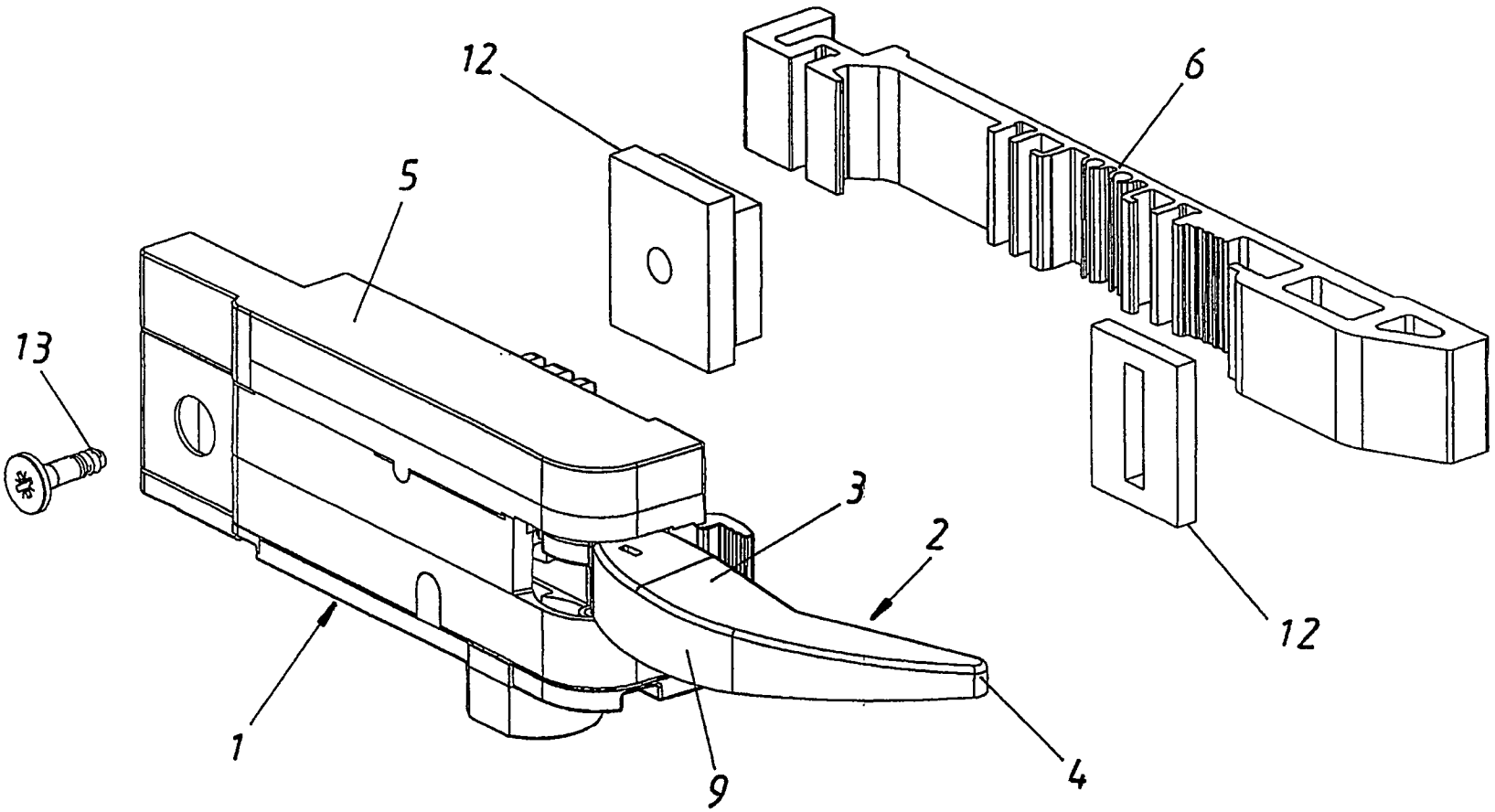
FIG. 8 is a perspective view of the design examples shown in FIGS. 5*a* and 7, with components for fitting into an item of furniture, and FIG. 9*a, b* are a diagrammatic comparison between a lever in an ejection device according to the state of the art and a lever in an ejection device according to the invention.
Figure 10:
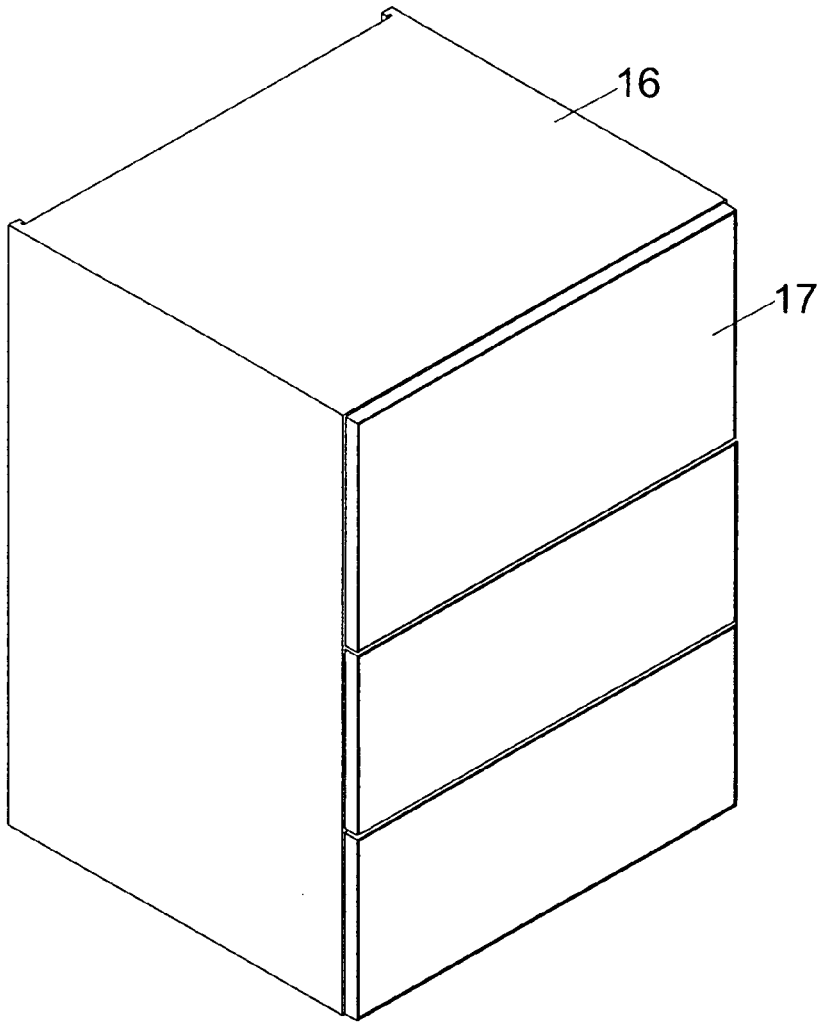
FIG. 10 is an illustration of a piece of furniture in which the ejection device of the present invention can be incorporated.

FIG. 8 is representative of all other design versions, wherein the design example from FIG. 7 is depicted in an exploded perspective view. In this case, the housing 5 of ejection device 1 can be secured to a carrier element 6 using noise damping pads 12 and a securing screw 13.

In general, it can be stated that the beneficial effects of the invention are already achieved when at least a curved section 9 is provided at a distance from the free lever end and the fulcrum. It is, of course, possible to provide additional curved sections 14 as shown in all of the design versions, whereby these sections can extend right to the free lever end 4 and/or the fulcrum point. However, this is not absolutely necessary.

A further advantage of the ejection device according to the invention is illustrated in the line diagrams in FIGS. 9*a* and 9*b*. This advantage is relevant when the ejection device is fitted with a touch-latch system. In this case, with the movable furniture part 8 in its closed end position, there is an amount of play between the furniture part 8 and the furniture body, so that the furniture part 8 can be moved in the direction of the furniture body. This is recorded by a sensor and reported to an actuation control unit. The actuation control unit, in turn, then activates the actuator 15, upon which, the ejection device pushes the movable furniture part out.

Figure 1A:
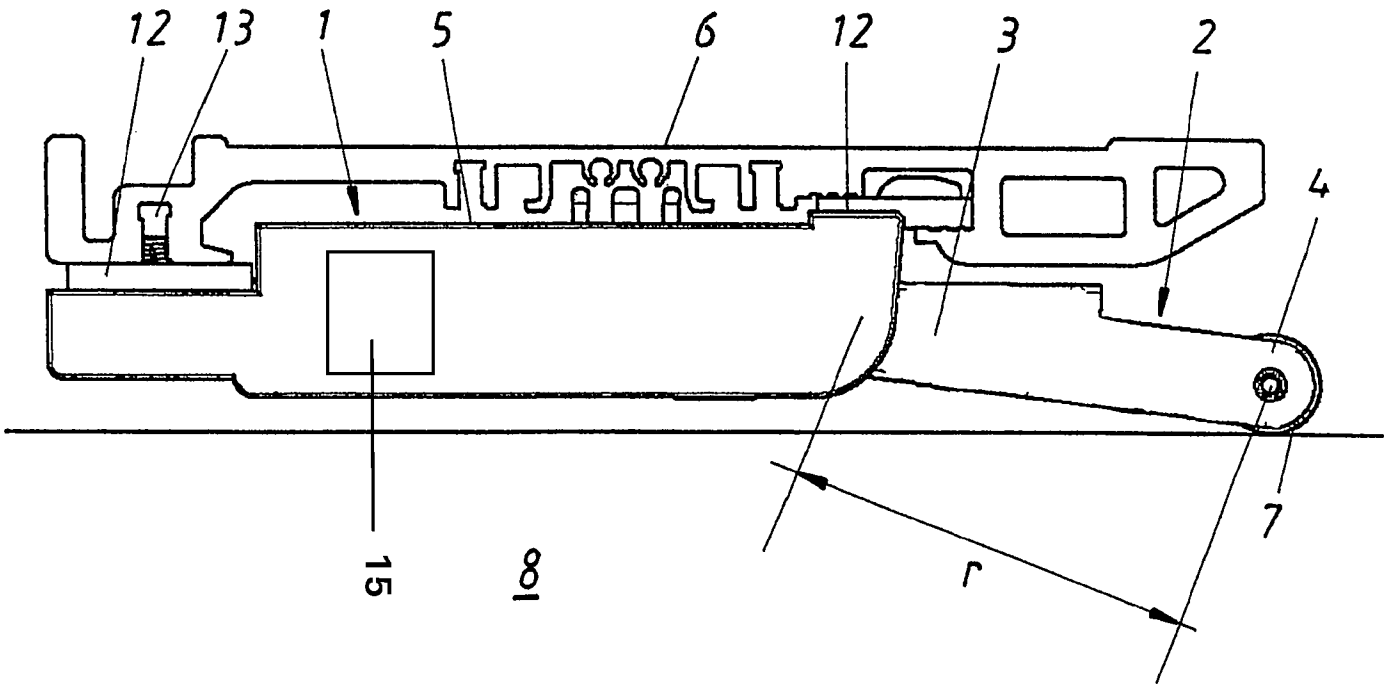
Fig. 1a PRIOR ART
FIG. 1*a, b, c* shows an ejection device according to the state of the art in diagrammatic form, and a graph of the force F and the current I supplied to the actuator plotted against the ejection path s, FIG. 2*a, b, c* are analogous illustrations of a further design example according to the state of the art, FIG. 3*a, b, c* are analogous illustrations of a first design example according to the invention, FIG. 4*a, b, c* are analogous illustrations of a further design example according to the invention, FIG. 5*a, b, c* are analogous illustrations of a further design example according to the invention, FIG. 6*a, b, c* are analogous illustrations of a further design example according to the invention.
Figure 1B:
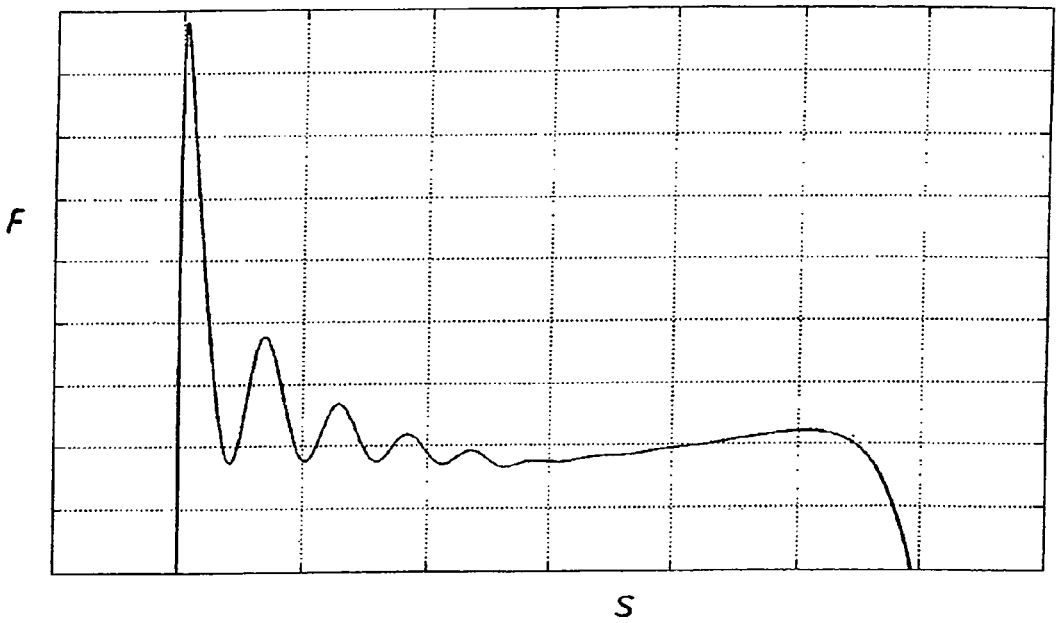
Fig. 1b PRIOR ART

FIG. 9*a* refers to the lever 2 shown in FIG. 1*a*, while FIG. 9*b* illustrates diagrammatically the situation for the lever 2 according to the invention in FIG. 3*a*.

In each case, the fulcrum 15 and the moment arm r are shown for two positions of lever 2. FIG. 9*a* distinguishes the positions separated by an angle μ', and in FIG. 9*b* by an angle μ. The different positions are based on a movable furniture part 8, not shown here, being moved a distance X towards the furniture body.

The change in angle μ' or μ, respectively, is therefore influenced by the distance X travelled. If the ejection device 1 is now designed such that the angular change μ' or μ, respectively, can be detected by the ejection device (such as by fitting a rotary potentiometer at the fulcrum point 15), pressure on the movable furniture part 8 can be used to trigger the ejection process (touch-latch system). It should be noted that, in the case of the state of the art (FIG. 9*a*), a relatively long moment arm r produces a small angular change μ' only.

In contrast, FIG. 9*b* shows that the same change in linear position X is associated with a far greater angular change μ, and with a short moment arm r. By using a lever 2 in the design example according to the invention, a user's intention to operate the device by pushing in the movable furniture part will be detected more surely since the value μ is larger than μ'.

The invention claimed is:

1. A furniture item comprising:
- a furniture body;
- a movable furniture part associated with said furniture body so as to be movable relative to said furniture body, said movable furniture part including an idler roller; and
- an ejection device including a lever for moving said movable furniture part, said lever having a pivotally-mounted lever body with:
  - a base end mounted so as to allow said lever body to pivot about a fulcrum point;
  - a free end opposite said base end; and
  - a curved section located between and spaced apart from said base end and said free end, said curved section being arranged to interact with and apply force to said idler roller of said movable furniture part so as to move said movable furniture part, said curved section being shaped such that a point of interaction between said curved section and said idler roller of said movable furniture part moves from a location adjacent to said fulcrum point towards said free end while said lever moves the movable furniture point, so as to thereby achieve a uniform change in a length of a moment arm between said fulcrum point and said point of interaction.

2. The furniture item of claim 1, wherein said ejection device further includes:
- a carrier element;
- a housing to which said lever body is pivotally mounted; and
- a noise damping pad for mounting said housing to said carrier element.

3. An ejection device for moving a movable furniture part, said ejection device comprising:
- a housing
- an electrical actuator arranged in said housing; and
- a lever for moving the movable furniture part, said lever being pivotally mounted to said housing and being connected to said electrical actuator so as to be movable via said electrical actuator, said lever having a pivotally-mounted lever body with:
  - a base end mounted so as to allow said lever body to pivot about a fulcrum point;
  - a free end opposite said base end; and
  - a curved section located between and spaced apart from said base end and said free end, said curved section being arranged to interact with and apply force to the movable furniture part so as to move the movable furniture part, said curved section being shaped such that a point of interaction between said curved section and the movable furniture part moves from a location adjacent to said fulcrum point towards said free end while said lever moves the movable furniture point, so as to thereby achieve a uniform change in a length of a moment arm between said fulcrum point and said point of interaction.

4. The ejection device of claim 3, wherein said lever body has an oblong shape, said curved section comprising a first curved section, said lever body having a second curved section located adjacent to said first curved section.

5. The ejection device of claim 3, wherein said curved section is arc-shaped.

6. The ejection device of claim 3, wherein said curved section of said lever body is shaped and arranged to maintain contact with a raised portion of the movable furniture part when said curved section interacts with and applies force to the movable furniture part.

7. The ejection device of claim 6, wherein the raised portion comprises an idler roller on the movable furniture part.

8. The ejection device of claim 3, wherein said curved section of said lever body is shaped and arranged such that said point of interaction between said curved section and the movable furniture part is located closer to said fulcrum point than to said free end when the movable furniture part is in a closed position.

9. The ejection device of claim 3, wherein the movable furniture part comprises a drawer, said curved section of said lever body being shaped and arranged so as to rest against a rear wall of the drawer when the drawer is in a closed position.

10. The ejection device of claim 3, further comprising:
- a carrier element; and
- a noise damping pad for mounting said housing to said carrier element.

11. The ejection device of claim 3, wherein said curved section of said lever body has a non-constant radius of curvature between said base end and said free end.

12. The ejection device of claim 3, wherein said curved section of said lever body comprises a first curved section adjacent to said base end, said lever body having a second curved section adjacent to said free end of said lever body, and said first curved section having a radius of curvature smaller than a radius of curvature of said second curved section.

13. A furniture item comprising:

a furniture body;

a movable furniture part associated with said furniture body so as to be movable relative to said furniture body; and an ejection device for moving said movable furniture part, said ejection device comprising:

a housing;

an electrical actuator arranged in said housing; and a lever for moving said movable furniture part, said lever being pivotally mounted to said housing and being connected to said electrical actuator so as to be movable via said electrical actuator, said lever having a pivotally-mounted lever body with:

a base end mounted so as to allow said lever body to pivot about a fulcrum point;

a free end opposite said base end; and a curved section located between and spaced apart from said base end and said free end, said curved section being arranged to interact with and apply force to said movable furniture part so as to move said movable furniture part, said curved section being shaped such that a point of interaction between said curved section and said movable furniture part moves from a location adjacent to said fulcrum point towards said free end while said lever moves said movable furniture point, so as to thereby achieve a uniform change in a length of a moment arm between said fulcrum point and said point of interaction.

14. The furniture item of claim 13, wherein said lever body has an oblong shape, said curved section comprising a first curved section, said lever body having a second curved section located adjacent to said first curved section.

15. The furniture item of claim 13, wherein said curved section is arc-shaped.

16. The furniture item of claim 13, wherein said curved section of said lever body is shaped and arranged to maintain contact with a raised portion of said movable furniture part when said curved section interacts with and applies force to said movable furniture part.

17. The furniture item of claim 16, wherein said raised portion comprises an idler roller on said movable furniture part.

18. The furniture item of claim 13, wherein said curved section of said lever body is shaped and arranged such that said point of interaction between said curved section and said movable furniture part is located closer to said fulcrum point than to said free end when said movable furniture part is in a closed position.

19. The furniture item of claim 13, wherein said movable furniture part comprises a drawer, said curved section of said lever body being shaped and arranged so as to rest against a rear wall of said drawer when said drawer is in a closed position.

20. The furniture item of claim 13, wherein said ejection device further includes:

a carrier element; and a noise damping pad for mounting said housing to said carrier element.

21. The furniture item of claim 13, wherein said curved section of said lever body has a non-constant radius of curvature between said base end and said free end.

22. The furniture item of claim 13, wherein said curved section of said lever body comprises a first curved section adjacent to said base end, said lever body having a second curved section adjacent to a free end of said lever body, and said first curved section having a radius of curvature smaller than a radius of curvature of said second curved section.

* * * * *